US005474220A

United States Patent [19]

Kishida

[11] Patent Number: 5,474,220

[45] Date of Patent: Dec. 12, 1995

[54] SUCCESSIVE SHEET FEED MECHANISM

[75] Inventor: Takeo Kishida, Suwa, Japan

[73] Assignee: Seiko Epson Corporation, Tokyo, Japan

[21] Appl. No.: 75,153

[22] Filed: Jun. 10, 1993

[30] Foreign Application Priority Data

Jun. 11, 1992 [JP] Japan ..... 4-152393

[51] Int. Cl.[6] ..... B65H 20/20; B41J 11/30

[52] U.S. Cl. ..... 226/74

[58] Field of Search ..... 226/74, 75; 400/616.1

[56] References Cited

U.S. PATENT DOCUMENTS

| | | | |
|---|---|---|---|
| 3,825,202 | 7/1974 | Robinson . | |
| 4,189,078 | 2/1980 | Spisz | 226/74 |
| 4,389,007 | 6/1983 | Seitz | 226/74 |
| 4,533,074 | 8/1985 | van Thiel | 226/74 |
| 4,546,908 | 10/1985 | Cassese et al. | 226/75 |
| 4,550,623 | 11/1985 | Gysling | 226/75 |
| 5,163,593 | 11/1992 | Yamashiti | 226/75 |

FOREIGN PATENT DOCUMENTS 1-271344 10/1989 Japan .

3-216447 9/1991 Japan .

*Primary Examiner*—Daniel P. Stodola
*Assistant Examiner*—Eileen A. Dunn
*Attorney, Agent, or Firm*—Stroock & Stroock & Lavan

[57] ABSTRACT

A sheet feed mechanism including a first tractor slidably mounted onto a drive shaft and a guide shaft respectively disposed between a first and a second frame of the printer. A wire is passed through the first tractor and is stretched between the first and second frames by the use of a tension spring or another energizing device connected to one end of the wire adjacent the first frame. Both the first tractor and the second tractor have pin belts with a plurality of pins disposed thereon for aligning and meshing with the holes in the sides of successive sheets of paper. Furthermore, the first tractor includes a fixing assembly for fixing the first tractor to the wire, and also including a loosening assembly which, essentially simultaneously when or after the first tractor is fixed to the wire, produces a loosened portion in the wire at a position thereof intermediate the fixing assembly and the second frame that would permit the first tractor to slide on the drive and guide shaft to compensate for any increase or decrease in the width of a successive sheet of paper due to a change in temperature, humidity or the like.

19 Claims, 14 Drawing Sheets

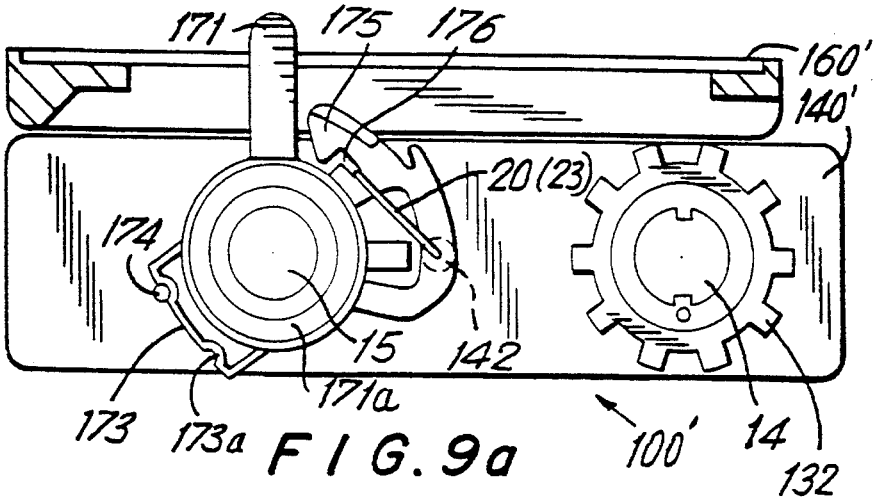
FIG. 9a
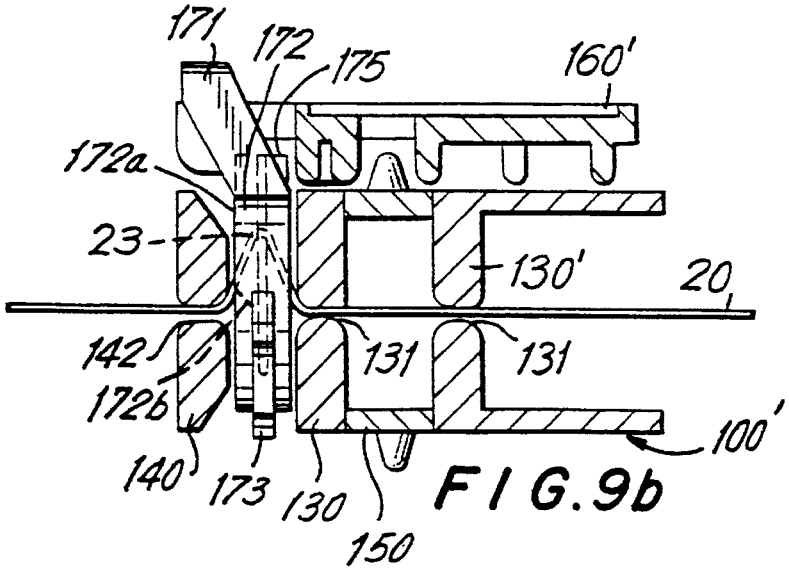
FIG. 9b
FIG. 9c
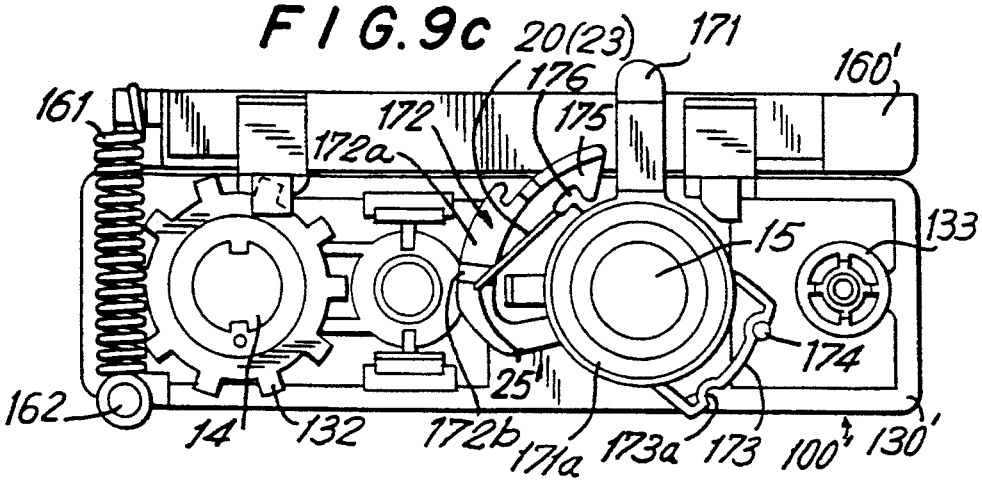

SUCCESSIVE SHEET FEED MECHANISM

BACKGROUND OF THE INVENTION

The present invention relates generally to a successive sheet feed mechanism for use in a printing device such as a printer or the like. In particular, the present invention relates to a successive sheet feed mechanism that is able to feed successive sheets in the forward or reverse direction when the width of the successive sheets increase or decrease due to a change in temperature, humidity or the like.

Generally, a conventional successive sheet feed mechanism includes a pair of tractors with each tractor having a pin belt. The tractor is designed to mesh the holes, respectively formed along the two side portions of each sheet of paper, with the pins provided on the pin belts to feed the successive sheets of paper in the forward or reverse direction.

If the width of the successive sheets of paper increase or decrease due to a change in temperature, humidity or the like, and the position of the pair of tractors (that is, pin belts) is fixed, then the holes in the successive sheets will not be properly aligned with the pins in the pin belts, thereby resulting in the successive sheets of paper not being correctly fed in the forward conveying or reverse conveying direction.

Japanese Patent Laid Open Publication Nos. 1-271344 (Heisei) and 3-216447 (Heisei), respectively, describe proposed sheet feeding mechanisms that attempt to solve the heretofore mentioned problem.

FIG. 1 depicts the sheet feed mechanism described in Japanese Patent Laid Open Publication No. 1-271344 of Heisei.

As shown in FIG. 1, a frame member 3 is slidably mounted onto a drive shaft 1 and a guide shaft 2. A tractor 4 is installed in frame member 3 and is slidably mounted onto drive shaft 1 and guide shaft 2. Tractor 4 is forced in direction X1 by a pair of springs 5 between frame member 3 and tractor 4. Holes 6*a* are respectively formed on the two side portions of each successive sheet 6. The sheet feed mechanism has an endless pin belt, which is not shown in FIG. 1, with a plurality of pins 4*a* disposed thereon. Pins 4*a* are to be aligned and meshed with holes 6*a* to convey the paper in a forward or reverse direction. A cover plate 4*b* is provided for covering each successive sheet 6 loosely by holding the two portions of each successive sheet 6 on opposed sides of holes 6*a* between the pin belt and cover plate 4*b*. Cover plate 4*b* has an elongated hole 4*c* that allows pins 4*a* to extend therethrough. Furthermore, a lock mechanism 7 selectively secures frame member 3 to guide shaft 2 so that frame member 3 can be prevented from being slidable. Although FIG. 1 depicts only the left sheet feed mechanism, the right sheet feed mechanism is identical to the mechanism in FIG. 1 except to the extent that the right sheet feed mechanism does not include frame member 3, and is also fixed to drive shaft 1 and guide shaft 2.

Reference is now made to FIGS. 2*a* and 2*b* to describe the operation of aligning successive sheet 6 to the thus constructed sheet feed mechanism. First align the holes on the right side of successive sheet 6 on the right tractor (not shown) which is fixed to drive shaft 1 and guide shaft 2. Then, after lock mechanism 7 has been released, frame member 3 and tractor 4 are slidable to thereafter bring pins 4*a* of tractor 4 into alignment with holes 6*a* of successive sheet 6. Cover plate 4*b* is then closed, loosely trapping the side portions of successive sheet 6 between the pin belt and cover plate 4*b*. Then, frame member 3 is pulled in the direction of arrow c, as shown in FIG. 2*b*, thereby producing a clearance S between frame member 3 and tractor 4. Frame member 3 can be locked in place by lock mechanism 7 and successive sheet 6 is properly set.

In this arrangement, successive sheet 6 always has applied to it a tensile force caused by spring 5, causing tautness in each sheet in the widthwise direction.

Therefore, even if the width W of successive sheet 6 increases or decreases due to a change in temperature, humidity or the like, the increase or decrease is compensated by the sliding of tractor 4 along drive shaft 1 and guide shaft 2. In this manner, each successive sheet 6 can be conveyed in the forward or the reverse direction.

The conventional sheet feed mechanism employing the structures described above has the drawback that it is necessary to provide frame member 3, which makes the mechanism very complicated.

FIG. 3 depicts a second prior art embodiment of a sheet feed mechanism as described in Japanese Patent Laid Open Publication No. 3-216447 (Heisei). This embodiment attempts to eliminate the above-mentioned problem of an overly complicated mechanism. In this embodiment, reference numeral 8 designates generally left and right tractors mounted on a drive shaft 1 and guide shaft 2, the right tractor being shown with its cover plate 8*d* open, the left tractor being shown with its cover plate 8*d* closed. Each tractor 8 includes a main body generally indicated at 8*a* and a pin belt 8*b*. Main body 8*a* is used as the above-mentioned frame member 3 (FIG. 1). A pin belt 8*b* is slidable with respect to main body 8*a* on shaft 8*e*. A spring 8*c* is positioned between main body 8*a* surrounding each shaft 8*e* and pulleys (not shown) over which pin belt 8*b* is extended are respectively slidably mounted on shafts 8*e*, one of the pulleys being operatively coupled to drive shaft 1.

The conventional sheet feed mechanisms employing the structures described above have the following problems.

First, if a proper clearance S is not formed between tractor 4 and frame member 3, as shown in FIGS. 1 and 2, or between pin belt 8*b* and main body 8*a*, as shown in FIG. 3, the proper alignment for the successive sheets of paper cannot be obtained. For example, if in FIG. 2*b*, clearance S is set too small, tractor 4 will not be able to extend the amount necessary to compensate for the width of successive sheet 6 if the increase in the width of successive sheet 6 is greater than clearance S. On the other hand, if clearance S is set too large, then tractor 4 will not be able to contract the necessary distance to compensate for the decrease in width of successive sheets 6. As shown in FIG. 2*a*, if clearance S is set at zero because of operator misoperation, tractor 4 cannot extend at all. When tractor 4 cannot follow the extension or contraction of successive sheets 6, then the successive sheets cannot be conveyed properly.

Further, in the conventional sheet feed mechanisms described above, if the sheet is not set properly and the clearance S is caused to vary, it is extremely difficult to obtain the proper operation. To obtain a desired operation, it is necessary to adjust the sheet precisely to provide for a proper clearance S. This precise adjustment requires complicated setting mechanisms and operator skill.

Furthermore, while frame member 3 is being adjusted in the direction of an arrow c against the tensile force of the spring, lock mechanism 7 must be essentially simultaneously adjusted, which makes it difficult for some to use the mechanism.

Accordingly, it is desired to provide an improved successive sheet feed mechanism having a construction which will allow for easy adjustments and settings and will also allow successive sheets to be conveyed even if the sheets shrink or expand.

SUMMARY OF THE INVENTION

Generally speaking, in accordance with the present invention, a successive sheet feed mechanism is provided including a drive shaft extended between first and second frames positioned a distance from each other, first and second tractors each including a pin belt with a plurality of pins disposed thereon and supported by the drive shaft so that, when driven by the drive shaft, the pins disposed on the pin belt are aligned and engaged with holes respectively formed on the two side portions of each successive sheet of paper so that each successive sheet can be conveyed in a forward or reverse direction. The mechanism further includes a guide member mounted between the first and second frames for supporting at least the first tractor so that at least the first tractor is slidable with respect to the drive shaft; a linear member extended between the first and second frames and passing through at least the first tractor; an energizing means (which can be in the form of a spring means) disposed nearer to the first frame than the first tractor for creating a tension force in the linear member; fixing means disposed on the first tractor for fixing the first tractor to the linear member; and, a loosening means for producing a loosened portion in the linear member at a position along the linear member intermediate the second frame and the fixing means at the same time when or after the linear member and first tractor are secured to each other by the fixing means.

Accordingly, it is an object of the present invention to provide an improved successive sheet feed mechanism.

It is another object of the present invention to provide an improved successive sheet feed mechanism that conveys paper more easily even though the width of the paper may vary due to changing climate conditions.

Still further, it is object of the present invention to provide an improved successive sheet feed mechanism that has a simple construction.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 5(*b*) is an enlarged cross-sectional view of the structure of a first tractor in accordance with the first embodiment of the invention showing the operation of the first tractor with the lock lever in the locked position;

FIG. 5(*c*) is a cross-sectional view taken along the line 5(*c*)— 5(*c*) in FIG. 5(*a*);

FIG. 5(*d*) is a cross-sectional view taken along the line 5(*d*)—5(*d*) in FIG. 5(*a*);

FIG. 5(*e*) is a cross-sectional view taken along the line 5(*e*)—5(*e*) in FIG. 5(*b*);

FIG. 5(*f*) is a cross-sectional view taken along the line 5(*f*)—5(*f*) in FIG. 5(*b*);

FIG. 9(*a*) is a cross-sectional view taken along the line 9*a*—9*a* in FIG. 8;

FIG. 9(*b*) is an enlarged cross-sectional view taken along the line 9*b*—9*b* in FIG. 8;

FIG. 9(*c*) is a cross-sectional view taken along the line 9*c*—9*c* in FIG. 8 (with the side frame omitted);

FIG. 12(*b*) is a cross-sectional view taken along the line 9*b*—9*b* in FIG. 8 showing the lock lever in the locked position;

FIG. 12(*c*) is a cross-sectional view taken along the line 9*c*—9*c* in FIG. 8 (with the side frame omitted) showing the lock lever in the locked position;

FIG. 12(*d*) is a fragmentary enlarged view of a portion of FIG. 12(*b*);

DETAILED DESCRIPTION OF THE PREFERRED EMBODIMENTS

Figure 4:
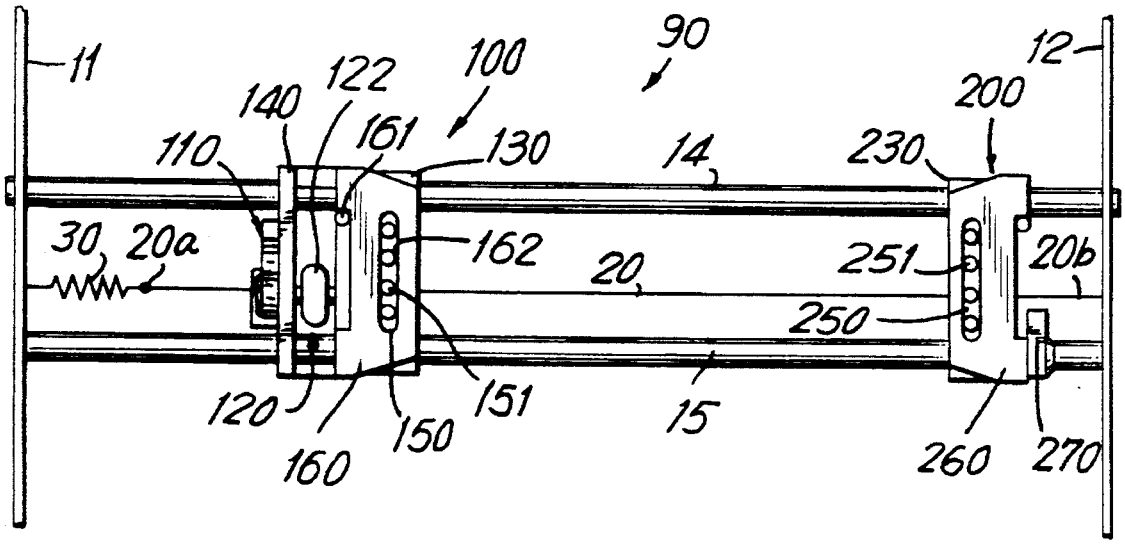
FIG. 4 is a plan view of a successive sheet feed mechanism in accordance with a first embodiment of the invention.
Figure 5A:
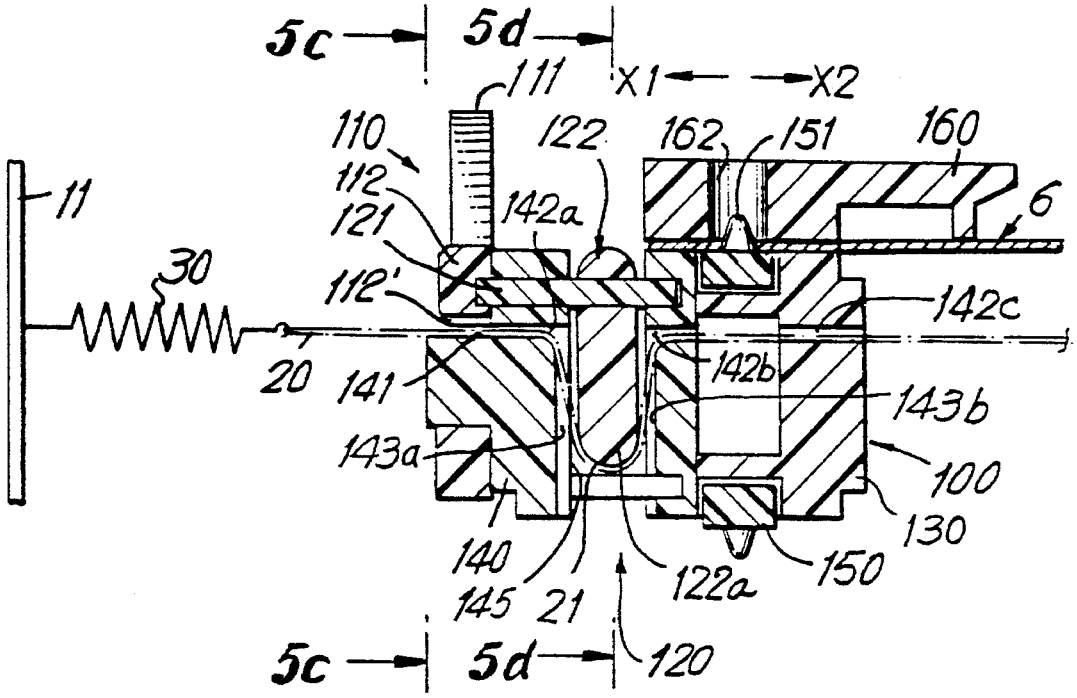
FIG. 5(*a*) is an enlarged cross-sectional view of the structure of a first tractor in accordance with the first embodiment of the invention with the lock lever in the unlocked position.
Figure 5B:
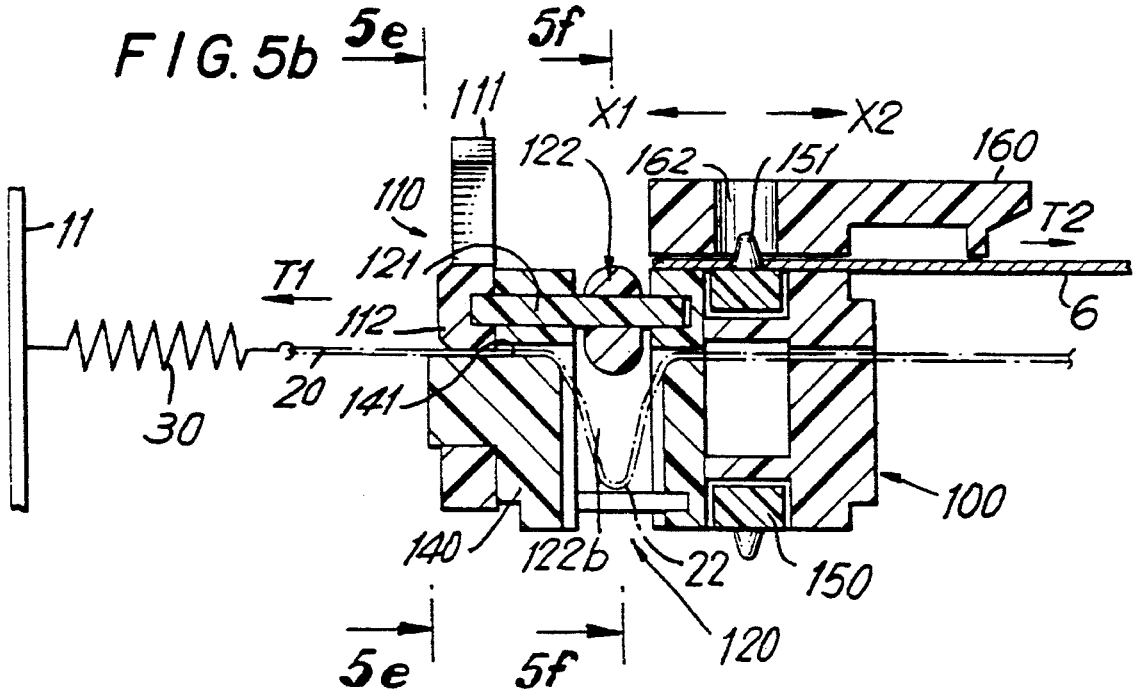
Figure 5C:
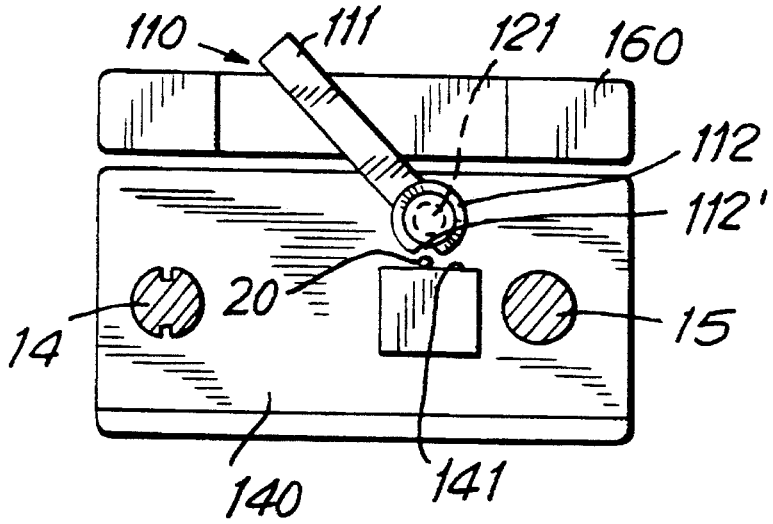
Figure 5D:
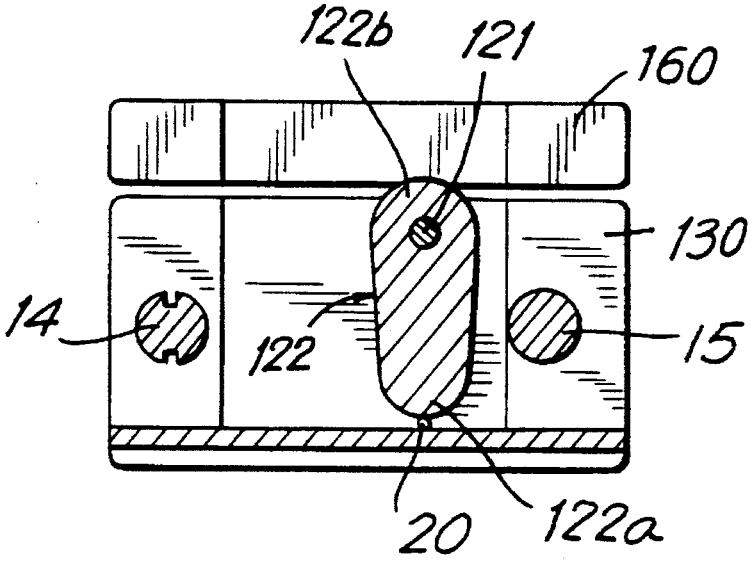
Figure 5E:
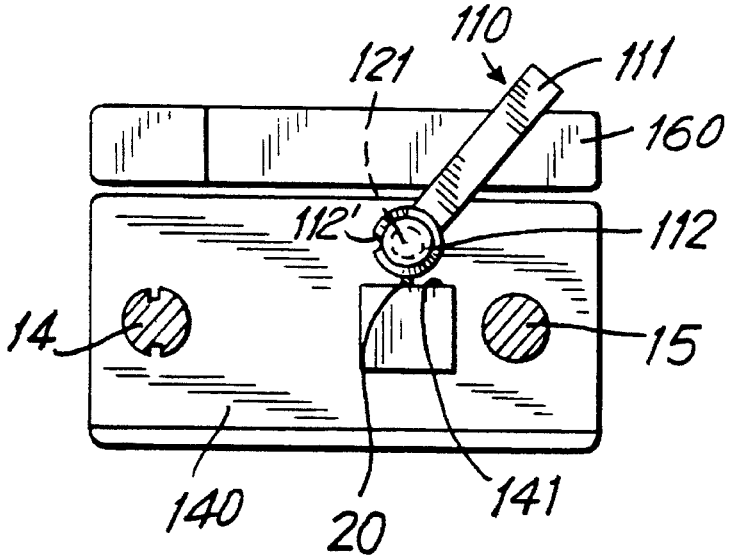
Figure 5F:
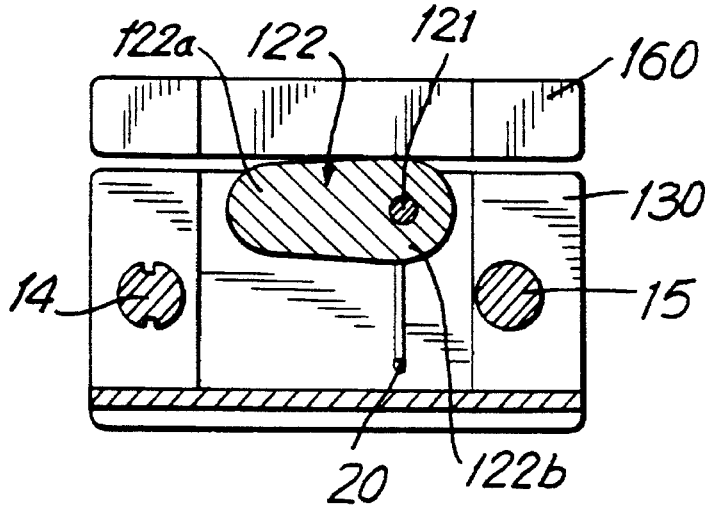
Figure 6A:
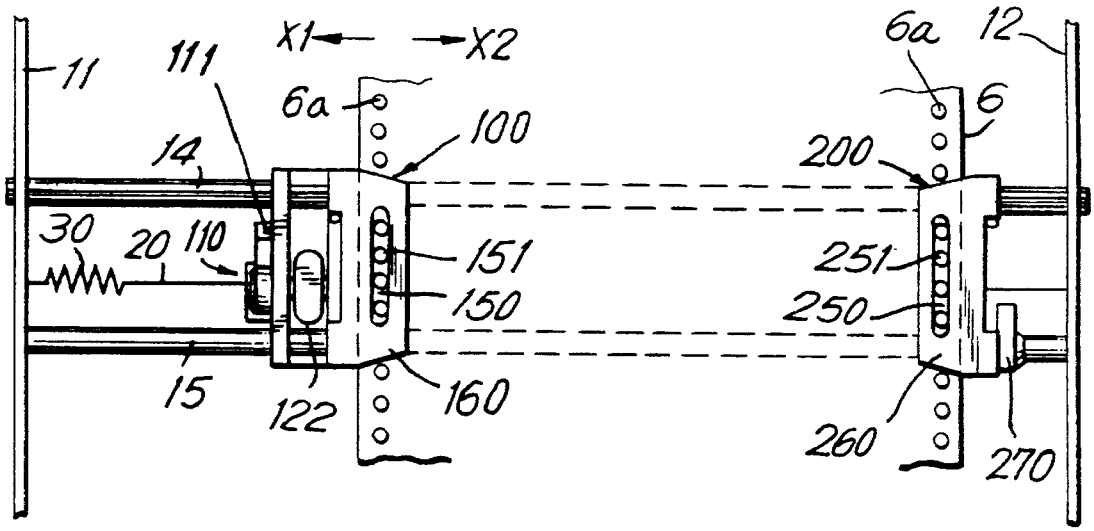
FIGS. 6(*a*) and 6(*b*) are plan views of the successive sheet feed mechanism of FIG. 4 showing the sheet setting operation in accordance with the first embodiment of the invention.
Figure 6B:
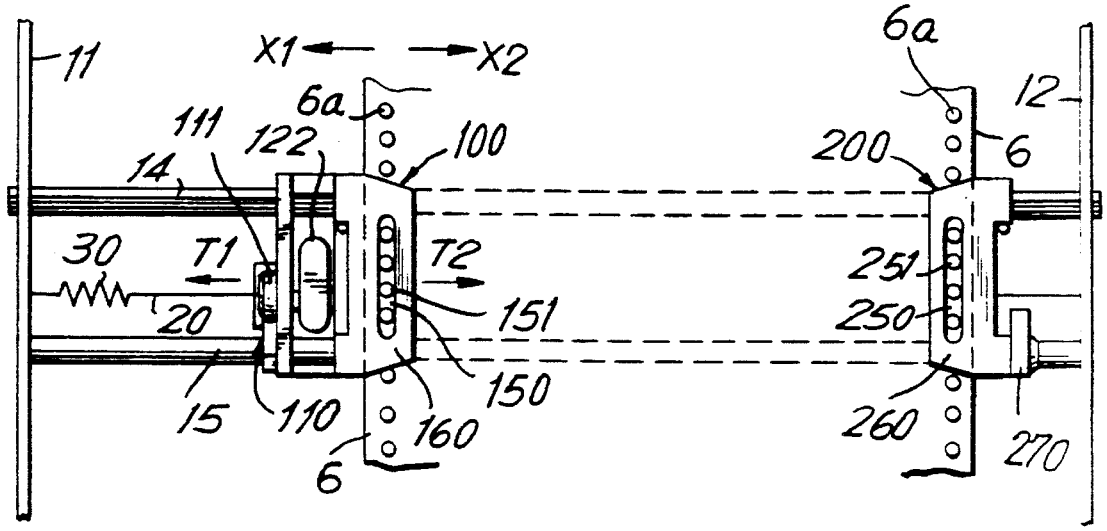
Figure 7:
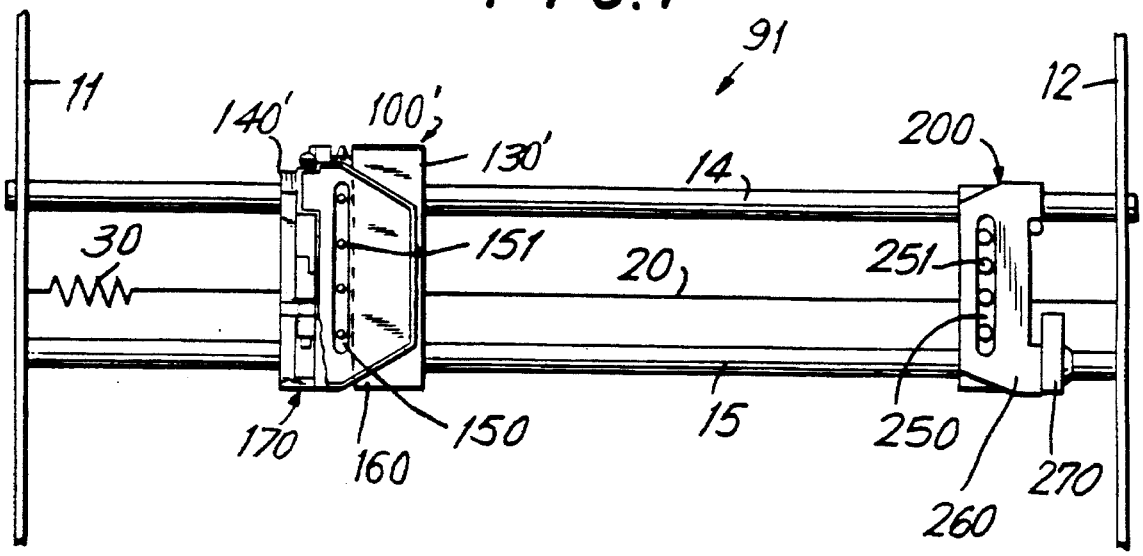
FIG. 7 is a plan view of a successive sheet feed mechanism in accordance with a second embodiment of the invention.
Figure 8:
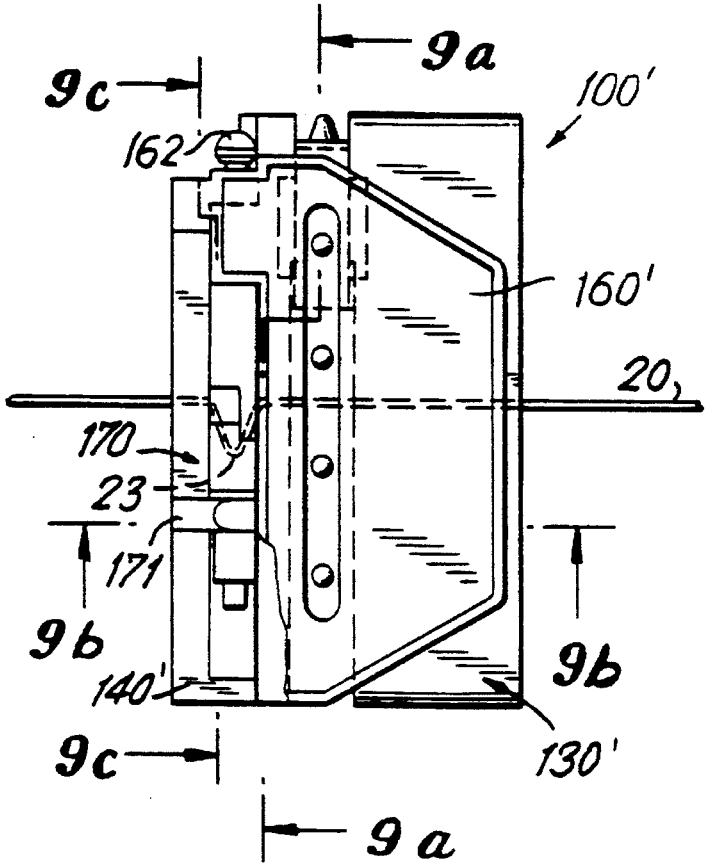
FIG. 8 is an enlarged plan view of the first tractor in FIG. 7 with a portion of the hold plate broken away.

Reference is first made to FIGS. 4 through 6 of the drawings which depict a successive sheet feed mechanism generally indicated at 90, constructed in accordance with a first embodiment of the present invention. Successive sheet feed mechanism 90 has a first frame 11 positioned a predetermined distance from a second frame 12. First frame 11 and second frame 12 are formed of the side frames of a printer or a similar device. Extending between first frame 11 and second frame 12 are a drive shaft 14 and a guide shaft 15. A first tractor generally indicated at 100 and a second tractor generally indicated at 200 are mounted on drive shaft 14 and guide shaft 15. A linear member 20, which can be formed of wire, is stretched between first frame 11 and second frame 12. Linear member 20 is fixed to first frame 11 through a tension spring 30. The use of a tension spring allows for a simple configuration. Tension spring 30 is positioned between first frame 11 and tractor 100, as illustrated in FIG. 4. A fixing assembly 110 and a loosening assembly 120 for cooperating with linear member 20 are respectively disposed on tractor 100.

Drive shaft 14 is rotatably mounted to first frame 11 and second frame 12 and can be rotationally driven by a drive mechanism (not shown). Guide shaft 15 is secured to first frame 11 and second frame 12 and serves as a guide member for supporting tractor 100 and tractor 200. Tractors 100 and 200 are slidable thereon.

Tractor 100 includes a main body generally indicated at 130 and a side frame 140 fixed to a side portion of main body 130. Main body 130 supports a rotatable drive pulley (not shown) (see a similar drive pulley at reference numeral 132 shown in FIG. 9(*a*)), a rotatable driven pulley (not shown), and a pin belt 150 positioned over the drive pulley and the driven pulley. Drive shaft 14 is inserted through the drive pulley and side frame 140 and couples with the drive pulley to rotate same. Guide shaft 15 is inserted through the driven pulley and side frame 140. Tractor 100 is slidable on drive shaft 14 and guide shaft 15. Pin belt 150 includes a plurality of pins 151 provided at regular intervals and spaced apart such that pins 151 mesh with the holes (see 6*a* shown in FIG. 6) along the sides of the successive sheets of paper to allow the sheets to be conveyed in the forward or reverse direction. Drive shaft 14 drives the drive pulley which in turn drives pin belt 150. Main body 130 also includes a pivotably mounted sheet hold plate 160 that can be opened or closed. When closed, hold plate 160 lightly presses down on each successive sheet by the force of a spring 161 positioned between main body 130 and hold plate 160. An elongated hole 162 is formed within sheet hold plate 160 to allow pins 151 to extend therethrough.

Second tractor 200 is constructed similarly to a conventional tractor and includes a main body, generally indicated at 230, a drive pulley (not shown), a driven pulley (not shown), a pin belt 250 with a plurality of pins 251 disposed thereon, and a sheet hold plate 260, all of which are similar to those in tractor 100. A slide lock lever 270 locks tractor 200 to guide shaft 15.

Linear member 20 is inserted through first tractor 100 and second tractor 200. A right end 20*b* of linear member 20 is fixed to second frame 12, while a left end 20*a* of linear member 20 is fixed to first frame 11 through tension spring 30. Tension spring 30 is the energizing means in the successive sheet feed mechanism in the present invention. That is, linear member 20 is stretched between first frame 11 and second frame 12 by the tensile force of tension spring 30.

In first tractor 100, there is a fixing assembly generally indicated at 110, for securing first tractor 100 with linear member 20. Linear member 20 extends through first tractor 100 and between first frame 11 and second frame 12. The tension force is created by tension spring 30, which is positioned nearer to first frame 11 than first tractor 100. In this configuration, if first tractor 100 is fixed to linear member 20 by securing assembly 110, then the tension force from tension spring 30 acts on first tractor 100 through linear member 20. Even when the tension force acts on first tractor 100, if it is assumed that linear member 20 is not loosened at all between the fixed position of first tractor 100 on linear member 20 and second frame 12, then first tractor 100 cannot slide in the direction of first frame 11, as the stretching of linear member 20 itself can be ignored.

Reference is now made to FIGS. 5(*a*) and 5(*b*) which depict an enlarged view of the fixing assembly 110 and a loosening assembly generally indicated at 120 of first tractor 100. Fixing assembly 110 includes a lock lever 111 rotatably mounted on side frame 140, and a hold portion 112 formed integrally with lock lever 111. Lock lever 111 can be in a locked position (as shown in FIGS. 5(*b*) and 5(*e*)) or an unlocked position (as shown in FIGS. 5(*a*) and 5(*c*)). FIGS. 5(*b*) and 5(*c*) shows hold portion 112 arranged to engage and secure linear member 20 against a hold portion 141 of side frame 140 when lock lever 111 is rotated to its locked position.

Loosening assembly 120 can produce a loosened portion 22 in linear member 20, in a region thereof intermediate second frame 12 and fixing assembly 110, essentially simultaneously when or after linear member 20 and tractor 100 are secured to each other by fixing assembly 110. In this way, first tractor 100 can slide toward first frame 11 by a maximum amount corresponding to the length of loosened portion 22 in linear member 20 produced by the loosening assembly. In a preferred embodiment, fixing assembly 110 is designed to fix first tractor 100 to linear member 20 immediately before loosening assembly 120 is displaced to produce loosened portion 22 of linear member 20.

Therefore, before tractor 100 is fixed to linear member 20, if first tractor 100.and second tractor 200 are set to the width of the successive sheet, and first tractor 100 is fixed to linear member 20 by fixing assembly 110, then the tension force from tension spring 30 acts on tractor 100 through linear member 20 while the above-mentioned loosened portion 22 produced in linear member 20 allows tractor 100 to be slidable toward first frame 11. At the same time, the tensile force by tension spring 30 is balanced with the tensile force that is produced in the successive sheets as the reaction force against the former tensile force.

In this state, if the width of the successive sheet increases, due to a change in temperature, humidity or the like, then the action of tension spring 30 causes first tractor 100 to slide toward frame 11 by an amount corresponding to the increase in the width of the successive sheet using the loosened portion 22. On the other hand, if the width of the successive sheet decreases, then the tensile force of the successive sheet causes first tractor 100 to slide in the direction of frame 12 by an amount corresponding to the decrease in the width of the successive sheet.

As described above, according to the successive sheet feed mechanism of the invention, since tractor 100 can slide according to the increase or decrease of the width of the successive sheet, an improved sheet feeding assembly can be realized.

In addition, the setting of a successive sheet to the sheet feed mechanism can be achieved by setting the successive sheet to the tractors and after that by setting the fixing assembly and the loosening assembly without requiring precision setting as was required in conventional sheet feed mechanisms. That is, in accordance with the invention, the setting of the successive sheet can be executed by a simple operation.

Loosening assembly 120, includes loosening assembly member 122 which has an eccentric cam shape which is rotatably mounted in a gap 145 between main body 130 and side frame 140 by a shaft 121. Loosening assembly member 122 is connected to lock lever 111 by shaft 121 for displacement thereby. Linear member 20 passes through openings 142*a*, 142*b* and 142*c* in main body 130, and is guided in grooves 143*a* and 143*b* on opposed sides of gap 145 around loosening assembly member 122. As shown in FIG. 5(*a*), when lock lever 111 is in an unlocked position, a smaller diameter portion 122*a* thereof engages linear member 20 in the space between main body 130 and side frame 140 to displace linear member 20 forcibly into a projecting shape against the tensile force of tension spring 30 (the displaced portion of linear member 20 is shown in FIG. 5(*a*) by reference numeral 21). FIG. 5(*c*) shows the position of hold portion 112 (a cylindrical member with a notched region 112' of smaller diameter) with respect to linear member 20 when lock lever 111 is in the unlocked position. In the unlocked position, notched region 112' is in registration with linear member 20 so that linear member 20 is slidable past hold portion 112 and first tractor 100 can easily slide on drive shaft 14 and guide shaft 15. FIG. 5(*d*) illustrates the position of loosening assembly member 122 when lock lever 111 is in the unlocked position. At this position, linear member 20 is forcibly displaced into a projecting shape to define what becomes loosened portion 22 in linear member 20 when the lock lever is moved to the locked position. As shown in FIG. 5(*e*), when lock lever 111 is set in the locked position, first linear member 20 is clamped between hold portions 112 and 141. Then, or essentially at the same time, projecting end 122*a* of loosening member 122 is rotated away from linear member 20 and short end 122*b* of loosening member 122 is brought into registration with linear member 20, thus removing the forced displacement of linear member 20 to produce a loosened portion 22 in linear member 20, as illustrated in FIG. 5(*f*).

FIGS. 6(*a*) and 6(*b*) depict the operation to set successive sheet 6 in the successive sheet feed mechanism of the first embodiment of the invention.

Reference is first made to FIG. 6(*a*). Hold plate 260 of second tractor 200 is opened, holes 6*a* formed on the right side of each successive sheet 6 are aligned with pins 251 respectively provided on pin belt 250, and thereafter hold plate 260 is closed. If necessary, second tractor 200 may be unlocked by a slide lock lever 270 to adjust the position of second tractor 200 on guide shaft 15 and drive shaft 14.

Similarly, hold plate 160 of first tractor 100 is opened, holes 6*a* of successive sheet 6 formed on the left side of sheet 6 are aligned with pins 151 on pin belt 150 of tractor 100 and, thereafter, hold plate 160 is closed.

During this operation, if lock lever 111 is set in the unlocked position (see FIG. 5(*a*)), then first tractor 100 can freely slide in the direction of either arrow X1 or arrow X2 in accordance with the width of successive sheet 6. When tractor 100 slides along linear member 20, linear member 20, as shown in FIG. 5(*a*), passes through tractor 100, and is displaced by projecting end 122*a* of loosening assembly member 122. Since first tractor 100 is not secured to linear member 20, the tensile force of tension spring 30 does not act on tractor 100.

Reference is now made to FIGS. 5(*b*) and 6(*b*), with lock lever 111 rotated to its locked position.

Linear member 20 is now held between hold portion 112 of lock lever 111 and hold portion 141 of side frame 140. Tractor 100 is fixed to linear member 20 by these hold portions, and projecting end 122*a* of loosening assembly member 122 is rotated out of registration with linear member 20 and short end 122*b* is brought into position in registration with linear member 20 to produce loosened portion 22 in linear member 20.

When tractor 100 is secured to linear member 20 in this manner, the tensile force T1 of tension spring 30 acts on tractor 100 through linear member 20. Notwithstanding tensile force T1, if loosened portion 22 did not exist in linear member 20 on the side thereof between second frame 12 and lock lever 111, first tractor 100 could not slide toward first frame 11, that is, in the direction of arrow X1, assuming the stretching of linear member 20 itself is neglected. However, in this embodiment of the invention, since loosened portion 22 is produced in linear member 20 at a position thereof between second frame 12 and lock lever 111, tractor 100 can slide in the direction of arrow X1 by an amount corresponding to the amount of loosened portion 22.

In other words, by rotating lock lever 111 to the locked position, tensile force T1 by tension spring 30 acts on tractor 100, loosened portion 22 is produced in linear member 20 allowing tractor 100 to slide in the X1 direction, and at the same time the tensile force T1 by tension spring 30 is balanced with a tensile force (see an arrow T2 in FIG. 6*b*) produced in the successive sheet 6 as a reaction against the tensile force T1.

In this state, if the width of successive sheet 6 increases due to a change in temperature, humidity or the like, then tractor 100, due to the action of tension spring 30, slides in the X1 direction by an amount corresponding to the increase in width of successive sheet 6. On the other hand, if the width of successive sheet 6 decreases, then tractor 100, due to the action of tensile force T2 of successive sheet 6, slides in the X2 direction by an amount corresponding to the decrease in width of successive sheet 6.

As described above, the successive sheet feed mechanism configured in accordance with this first embodiment will result in tractor 100 sliding in accordance with the increase or decrease in the width of successive sheet 6, and thereby allow for a proper conveyance of paper in the forward or the reverse direction.

Figure 1:
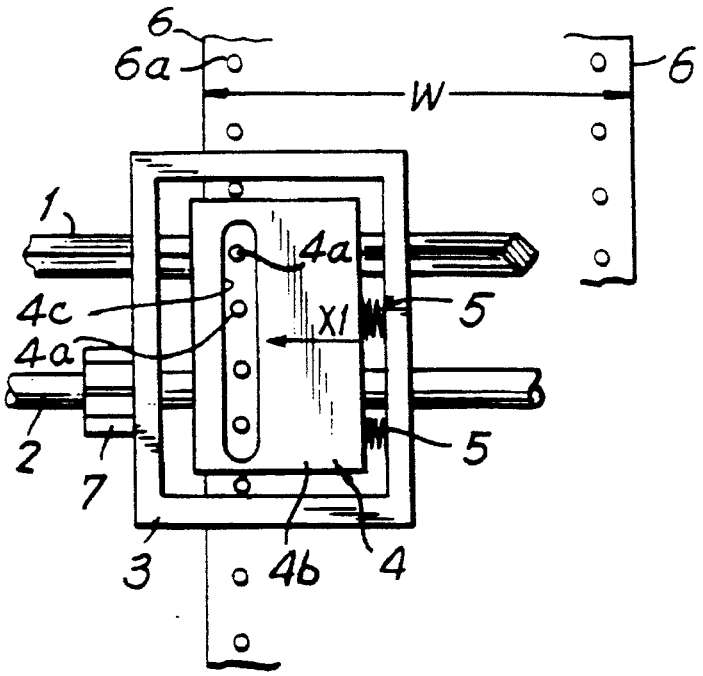
FIG. 1 PRIOR ART
FIG. 1 is a plan view of a conventional successive sheet feed mechanism in accordance with the prior art.
Figure 3:
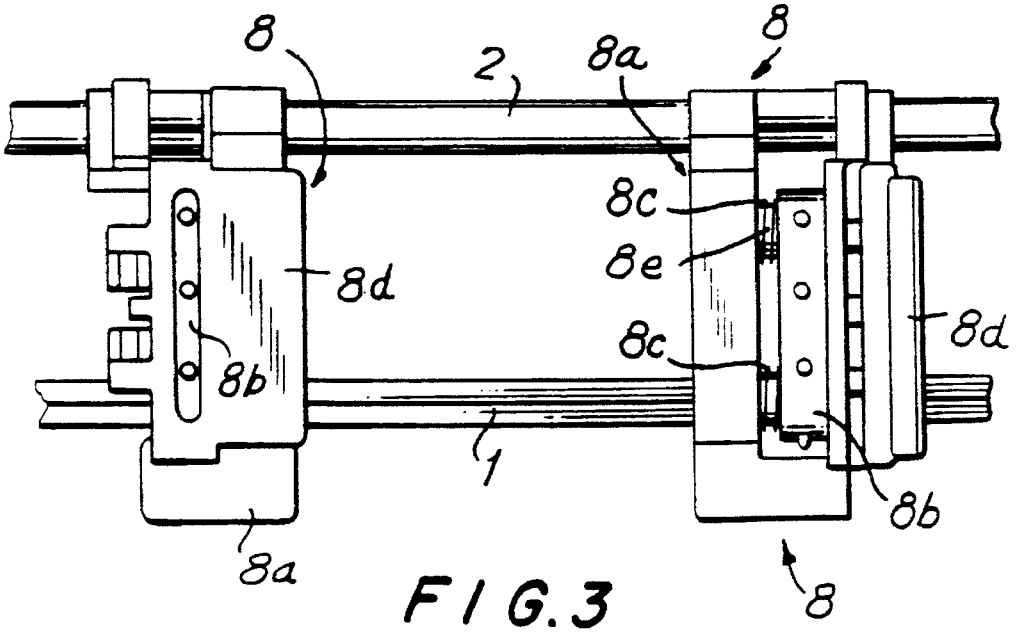
FIG. 3 PRIOR ART
FIG. 3 is a plan view of an alternate embodiment of a conventional successive sheet feed mechanism in accordance with the prior art.
Figure 2A:
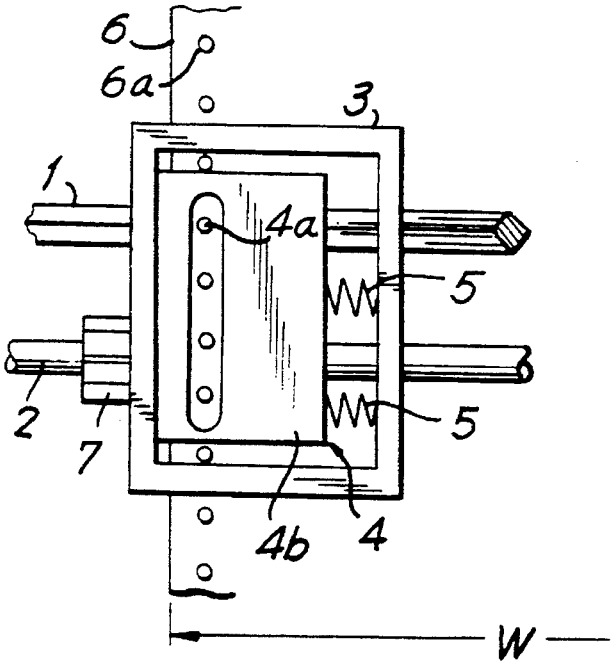
FIG. 2a PRIOR ART
FIGS. 2(*a*) and (b) are plan views of the conventional successive sheet feed mechanism of FIG. 1 showing the sheet setting operation as performed in the conventional mechanism.
Figure 2B:
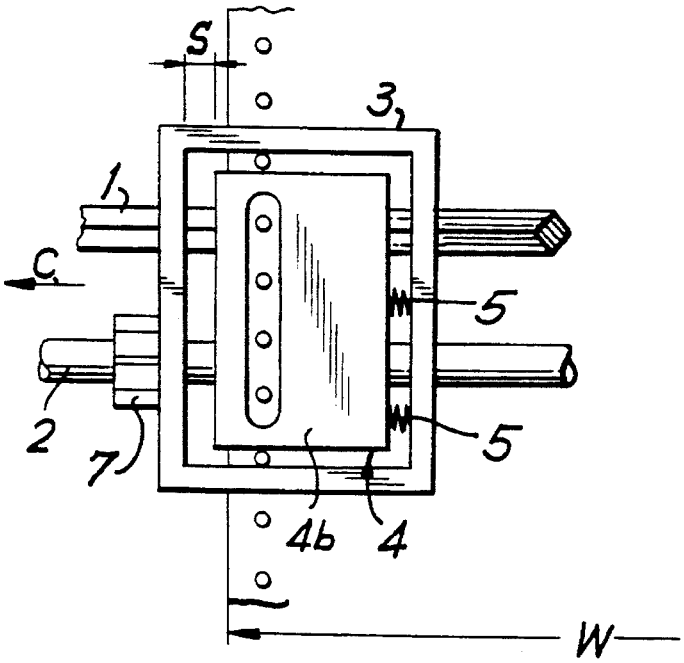
FIG. 2b PRIOR ART

Furthermore, proper alignment of each successive sheet 6 can be achieved simply by aligning successive sheet 6 on tractors 100 and 200 and, thereafter, setting lock lever 111 in its locking position. This eliminates the precision alignment necessary in conventional sheet feed mechanisms. In particular, the use of two hands to set the clearance S, as shown in FIG. 2, as was required, is now eliminated.

Reference is made to FIGS. 7–9*c*, disclosing a sheet feed mechanism shown generally at 91 in accordance with a second embodiment of the invention.

The second embodiment shows an alternate fixing assembly and an alternate loosening assembly and the remaining portions thereof are essentially similar in structure to those in the previously described first embodiment. Therefore, in FIGS. 7–9*c*, the parts of the second embodiment similar in structure to those in the first embodiment are respectively given the same reference numerals and the description thereof is omitted here.

In successive sheet feed mechanism 91, the fixing assembly includes a lock lever rotatably mounted onto the first tractor and capable of taking a locked position and an unlocked position, and a holding portion which, when the lock lever is rotated to the locked position, holds and secures the linear member between the tractor body and the fixing assembly. The holding portion is formed integrally with the lock lever so that the securing of the first tractor to the linear member can be achieved more simply by means of the operation of the lock lever.

A loosening assembly having a loosening member configured such that it forcibly displaces the linear member into a projecting shape against the tension force given by the tension spring at a position intermediate the fixing assembly and the second frame when the linear member and first tractor are not secured to each other, and that, essentially simultaneously when or after the linear member and first tractor are fixed to each other, it removes the forced displacement of the linear member to thereby produce a loosened portion in the linear member. Hence, the loosened portion is easily formed.

A first tractor, generally indicated at 100' includes a fixing assembly generally indicated at 170. Fixing assembly 170 includes a lock lever 171 mounted rotatably between main body 130' and side frame 140', and a hold portion 172 (see FIGS. 9*b*, 11 and 12) formed concentrically and integrally with a cylindrical base portion 171*a* (FIG. 9*a*) of lock lever 171. Lock lever 171 can be in a locked position (a position shown in FIGS. 12*a*–12*d*) or an unlocked position (a position shown in FIGS. 9*a*–9*c*).

Figure 11:
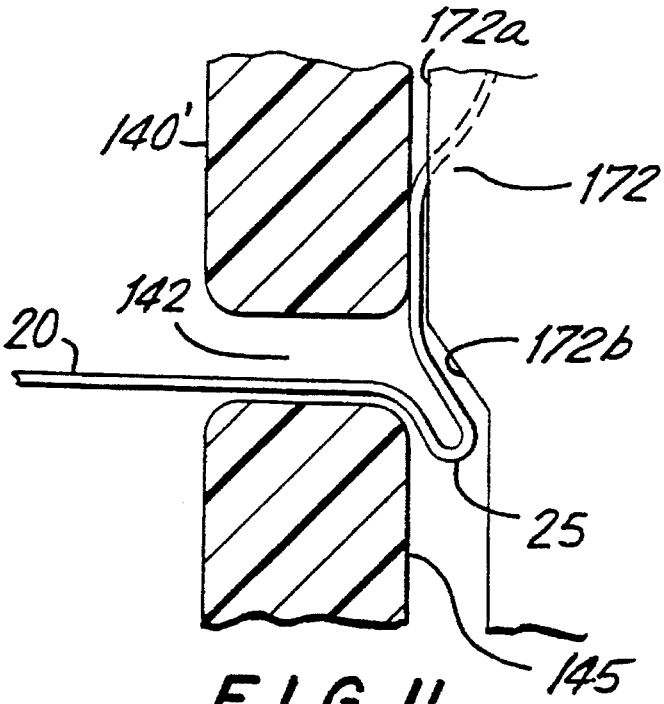
FIG. 11 is an enlarged fragmentary view of a portion of FIG. 10.
Figure 12A:
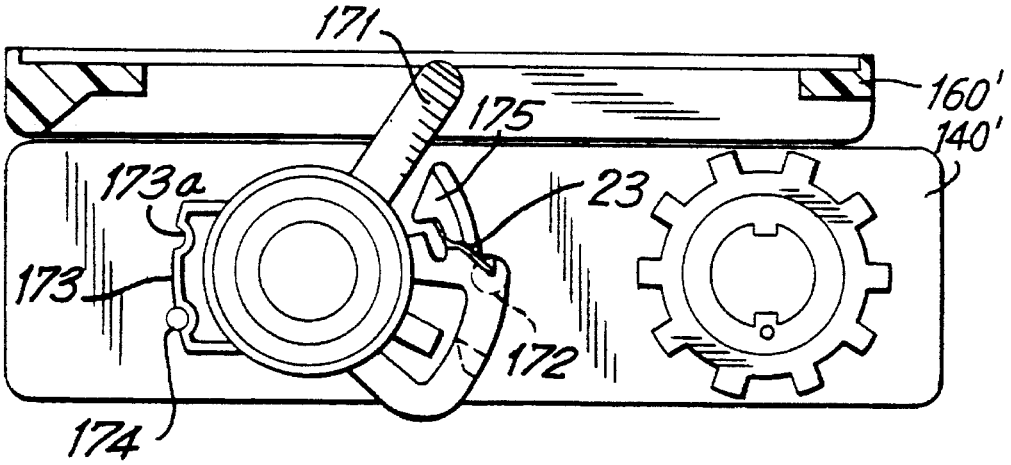
FIG. 12(*a*) is a cross-sectional view taken along the line 9*a*—9*a* in FIG. 8 showing the lock lever in the locked position.
Figure 12B:
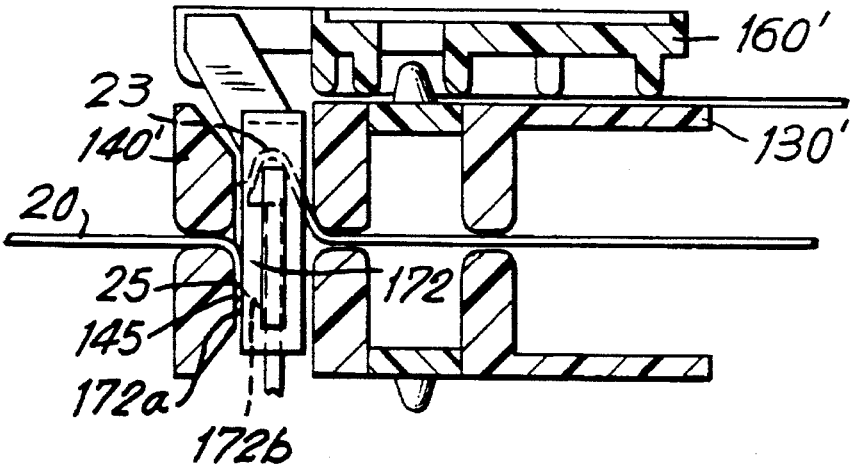
Figure 12C:
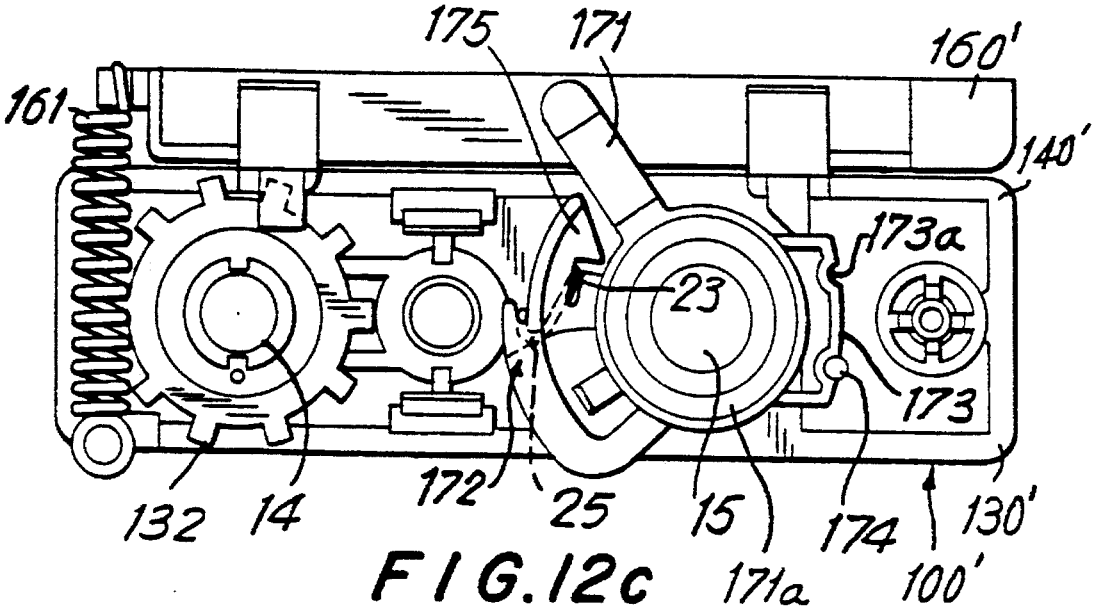
Figure 12D:
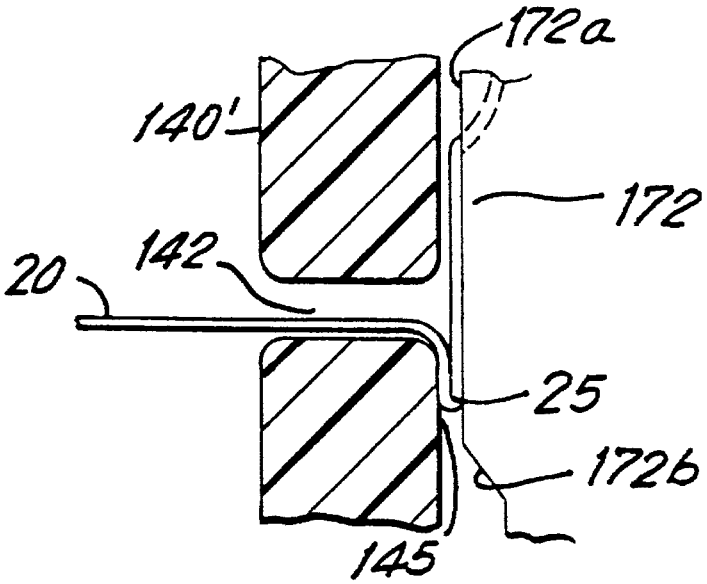

As shown in FIGS. 11 and 12*d*, hold portion 172 includes a flat portion 172*a* and an inclined portion 172*b* adjoining flat portion 172*a*. Hold portion 172 is designed so that when lock lever 171 is rotated to its locked position, it holds and fixes linear member 20 between hold portion 145 of side frame 140' and the flat portion 172*a* of hold portion 172. The portion of linear member 20 held by hold portion 172 is designated by reference numeral 25 (FIGS. 12(*b*) and (*d*)).

As shown in FIG. 9(*c*), when the lock lever 171 is in the unlocked position, a section 25' of linear member 20 hangs on the inclined portion 172*b* of hold portion 172 and, therefore, if the lock lever 171 is rotated to be placed in the locked position, then section 25', as shown in FIG. 11, is pushed down by the inclined portion 172*b* and is thus pushed in the direction of hold portion 145 of side frame 140'. And, when lock lever 171 is rotated to the locked position, section 25' is held by and between the flat portion 172*a* of hold portion 172 of lock lever 171 and hold portion 145 of side frame 140, as described above. FIGS. 9*a*–9*c* and 12*a*–12*c* show an elastic member 173 that is formed integrally with cylindrical base portion 171*a* of lock lever 171 to provisionally fix the lock lever 171 in the locked or unlocked position with a clicking feeling. In particular, a pair of recessed portions 173*a* formed in elastic member 173 are positioned to engage a pin 174 formed integrally with main body 130' or side frame 140', so that lock lever 171 can be provisionally fixed in the unlocked or locked position with a clicking feeling.

The loosening assembly employed in the present embodiment is composed of a hook portion 175 which is formed integrally with and extended from cylindrical base portion 171*a* of lock lever 171. Hook portion 175 is also formed integrally with the above-mentioned hold portion 172. The hook portion 175 includes a hook groove 176 in which the linear member 20 is placed. When lock lever 171 is set at its unlock position, and linear member 20 and tractor 100 are not secured to each other, as shown in FIGS. 8 and 9*a*–9*c*, hook portion 175 engages linear member 20 to forcibly displace linear member 20 into a projecting shape against the tensile force of the tension spring 30 at a position thereof intermediate second frame 12 and the fixed position of linear member 20 relative to first tractor 100' (the displaced portion is shown by reference numeral 23). Also, as shown in FIGS. 12*a*–12*d*, when the lock lever 171 is set in the locked position, hook portion 175 moves down to remove the forced displacement of linear member 20, thereby producing a loosened portion 23 in linear member 20.

Therefore, simply by rotating lock lever 171 to the locked position, linear member 20 can be held between the hold portion 172 of lock lever 171 and hold portion 145 of the side frame 140 and, by means of these hold portions, tractor 100' can be secured to linear member 20 and loosened portion 23 can be produced in linear member 20.

Also, according to the present embodiment, since fixing assembly 170 and loosening assembly 175 are respectively formed in a thin construction between main body 130' and side frame 140', tractor 100 can be made compact.

Figure 10:
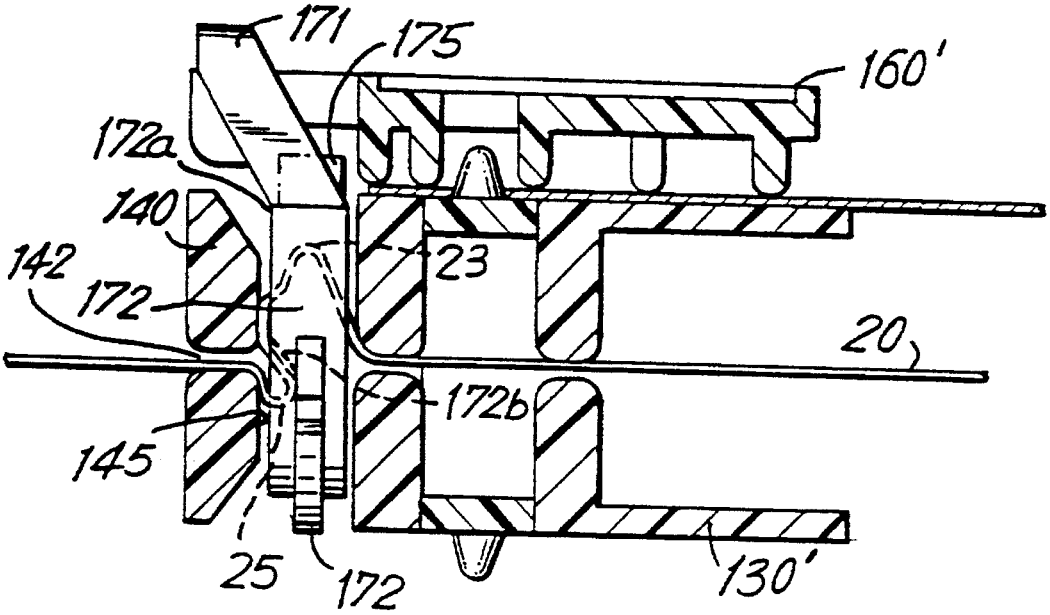
FIG. 10 is a cross-sectional view of the first tractor of FIG. 7 showing the operation of the second embodiment of the invention.

As shown in FIG. 9*a*, if tractor 100 is slidable with lock lever 171 in the unlocked position, then linear member 20 is passed within tractor 100 via a hook groove 176. As shown in FIG. 9*c*, drive pulley 132 and drive pulley 133 are provided to support the pin belt 150. Hold plate 160' is pivotably mounted to main body 130' by a hinge 162 and biased closed by spring 161. In FIG. 9*b*, 131 designates a hole formed in main body 130' through which linear member 20 is passed, and a hole 142 is formed in side frame 140' through which linear member 20 is passed. FIGS. 10 and 11 show linear member 20 with the fixing assembly 170 in the unlocked position.

Figure 13:
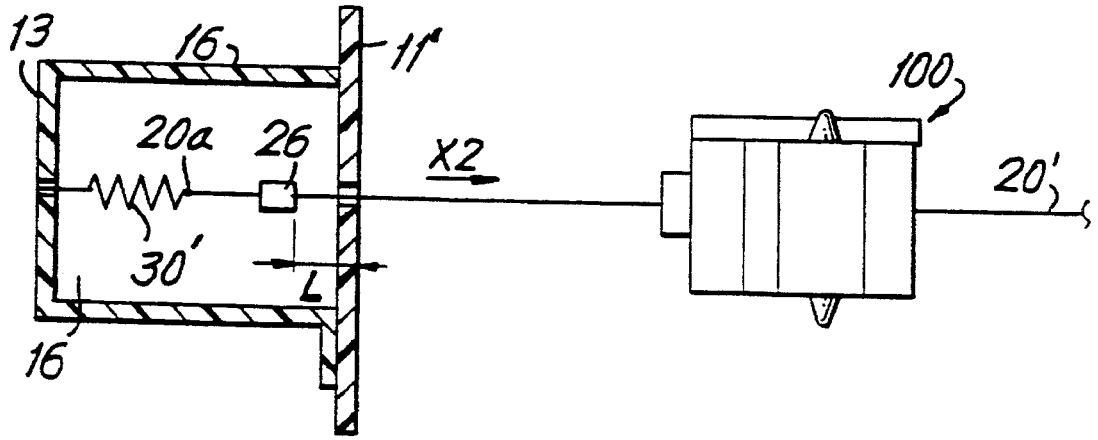
FIG. 13 is a schematic cross-sectional view of a third embodiment of a successive sheet feed mechanism according to the invention.

In a third embodiment of the invention, as shown in FIG. 13, aside from the structure of portions of tension spring 30, the remaining portions of the third embodiment are structured similarly to the first or second embodiments. In accordance with this alternate embodiment, a successive sheet feed mechanism is provided in which one end of the linear member is fixed to the second frame and the other end thereof is extended through the first frame and is fixed through a tension spring, which serves as the energizing means, to a third frame disposed at a distance from the first frame in the successive sheet feed mechanism as disclosed in the first or second embodiments of the invention.

In particular, left end 20*a* of linear member 20' is extended through first frame 11' and is fixed through tension spring 30' to a third frame 13 provided at a predetermined distance from first frame 11'. Tension spring 30' is positioned between first frame 11' and third frame 13. In addition, the periphery of tension spring 30' is covered with a cover member 16 which also defines third frame 13. This eliminates the possibility that the tension spring mounting portion of the present mechanism can be damaged in error while an operator is operating the present mechanism or when the present mechanism is under the maintenance operation.

A stopper 26 is secured to linear member 20' between tension spring 30 and first frame 11' and can contact first frame 11' to restrict the extension of tension spring 30 when linear member 20 is pulled in a direction indicated by arrow X2. A distance L between stopper 26 and first frame 11' is set greater than the amount of expected reduction of the successive sheet due to change in humidity or the like. However, the distance L is also set smaller than the amount of extension that would destroy the function of tension spring 30'. Therefore, the sliding range of tractor 100 between first frame 11' and second frame 12 must be properly set.

Also, the present structure eliminates the possibility of the tension spring slipping off or inadvertently being destroyed during the time when the present sheet feed mechanism is in use or is under the maintenance operation.

Further, even when, due to a misoperation, tractor 100 slides in the direction of arrow X2 towards second tractor 200, with the lock lever set in the locked position, locking tractor 100 and linear member 20 together, stopper 26 contacts first frame 11' to restrict the sliding movement of tractor 100, and also eliminates the possibility that tension spring 30' can be extended excessively and thereby damaged.

Figure 14:
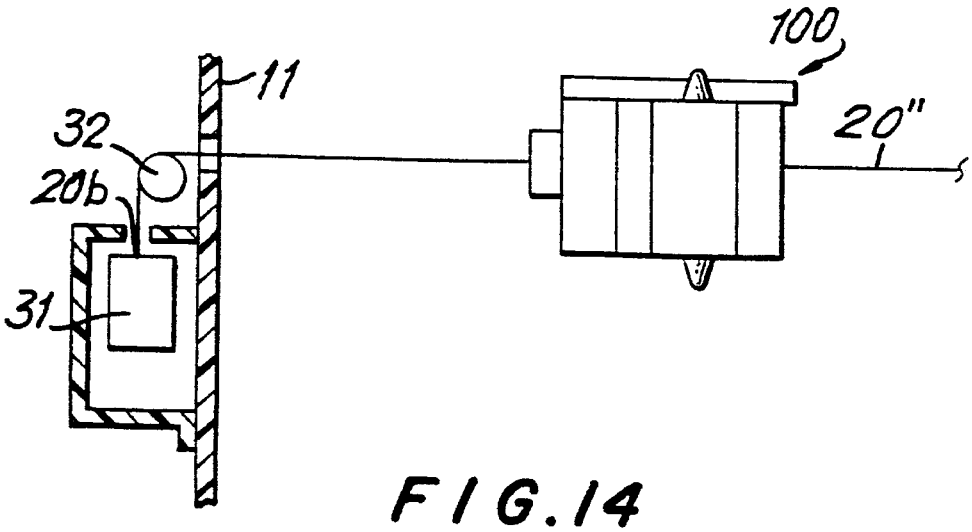
FIG. 14 is an enlarged schematic cross-sectional view of a fourth embodiment of a successive sheet feed mechanism according to the invention.

In accordance with a fourth embodiment of the invention, and as shown in FIG. 14, a right end of linear member 20" is fixed to second frame 12 and left end **20*b* thereof is extended through first frame 11 and is fixed to a weight 31**.

Weight 31 hangs from linear member 20" after it passes over a pulley 32 which guides linear member 20". In this embodiment, weight 31 is used instead of tension spring 30 as the energizing means and the remaining portions of the fourth embodiment are structured similarly to the above mentioned first and second embodiments. In accordance with this fourth embodiment, a sheet can be simply set in place and a positive sheet feed operation can be executed by a more simplified structure.

Figure 15:
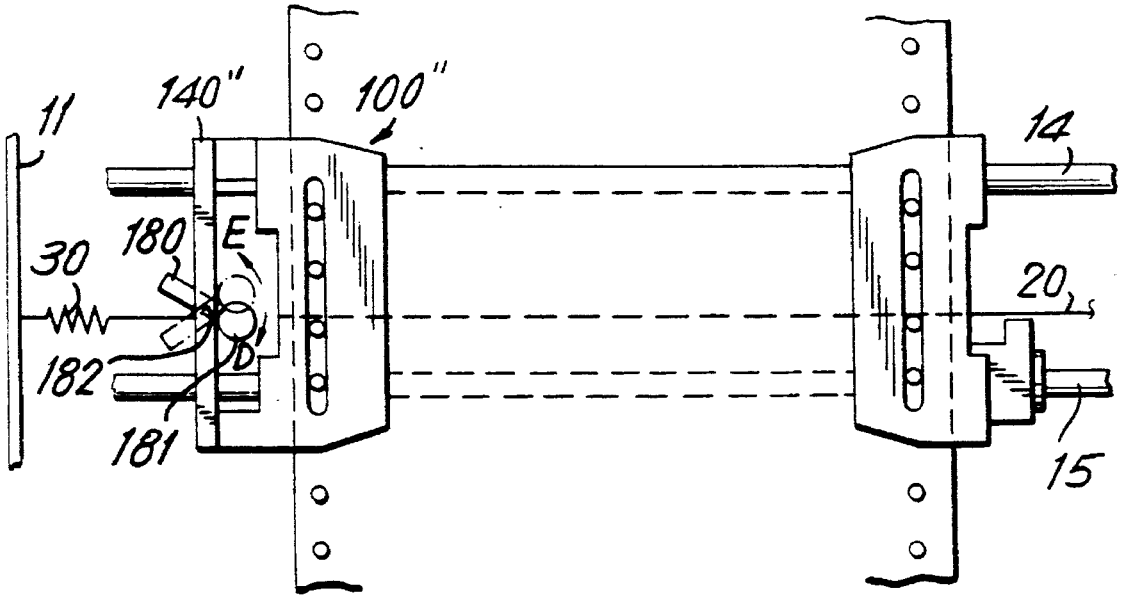
FIG. 15 is a plan view of a fifth embodiment of a successive sheet feed mechanism in accordance with the invention.

In accordance with a fifth embodiment of this invention and as shown in FIG. 15, a tractor generally indicated at 100", has a lever 180 rotatably mounted onto side frame 140", and a disk portion 181 is formed integrally with lever 180. When lever 180 is rotated in a direction of arrow D, disk portion 181 displaces linear member 20 forcibly into a projecting shape and, when lever 180 is rotated in a direction of arrow E, disk portion 181 removes the forced displacement of linear member 20 producing a loosened portion in linear member 20. In this case, means for fixing the linear member 20 is provided in the rotational support portion 182 of the lever 180.

Therefore, the successive sheet feed mechanism of the present invention results in a simple operation for conveying paper and a positive sheet feed operation can be executed. As noted, a successive sheet feed mechanism can also have a loosening assembly formed integrally with the lock lever as disclosed in the sixth embodiment. By operating the lock lever, tractor 100 can be fixed to the linear member and at the same time the linear member can be loosened so that an operation to set the successive sheet can be further simplified.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A successive sheet feed mechanism for feeding successive sheets of paper with holes in the sides thereof, comprising:

a first frame and a second frame positioned a predetermined distance from the first frame;

a drive shaft and a guide member each being disposed between said first frame and said second frame;

a first tractor being slidable on said drive shaft and said guide member, a second tractor mounted on said drive shaft and said guide member, said first tractor and said second tractor each having a pin belt with a plurality of pins disposed thereon, said pin belts being driven by said drive shaft, said pins being for aligning and meshing with the holes in the sides of successive sheets of paper for permitting the paper to be conveyed in the forward or reverse direction;

a linear member stretched between said first and said second frames and passing through at least said first tractor;

an energizing member secured to said linear member in a region close to said first frame to apply a tension to said linear member;

a fixing assembly carried by said first tractor displaceable to releasably fix said first tractor to said linear member at a location on said first tractor; and a loosening assembly displaceable to form a loosened portion in said linear member at a position between said location on said first tractor at which said fixing assembly fixes said first tractor to said linear member and said second frame, so that said first tractor can slide along said drive shaft and said guide member a distance relative to the second tractor to compensate for an increase or a decrease in the width of a successive sheet of paper when fixed to said linear member.

2. The successive sheet feed mechanism, as claimed in claim 1, wherein said linear member is made of wire.

3. The successive sheet feed mechanism, as claimed in claim 1, wherein one end of said linear member is secured to said second frame and said energizing member is secured between the other end of said linear member and said first frame.

4. The successive sheet feed mechanism, as claimed in claim 3, wherein said energizing member is a tension spring.

5. The successive sheet feed mechanism, as claimed in claim 1, and including a third frame positioned on the side of said first frame opposed to said second frame, said first frame being constructed to permit said linear member to extend therethrough, one end of said linear member being secured to said second frame and the other end of said linear member being secured to a first end of said energizing member, said energizing member being positioned between said first frame and said third frame.

6. The successive sheet feed mechanism, as claimed in claim 5, wherein said energizing member is secured between said third frame and said linear member.

7. The successive sheet feed mechanism, as claimed in claim 6, wherein said energizing member is a tension spring.

8. The successive sheet feed mechanism, as claimed in claim 5, further including a covering member for covering said energizing member and to protect said energizing members from damage.

9. The successive sheet feed mechanism, as claimed in claim 5, further including a stopper positioned between said first frame and said energizing member for contacting said first frame to prevent the overextension of said energizing member.

10. The successive sheet feed mechanism, as claimed in claim 1, wherein one end of said linear member is secured to said second frame and the other end of said linear member extends through said first frame and is connected to said energizing member.

11. The successive sheet feed mechanism, as claimed in claim 10, wherein said energizing member is a weight, said weight extending from said one end of said linear member to apply tension to said linear member.

12. The successive sheet feed mechanism, as claimed in claim 1, wherein said fixing assembly includes a lock lever mounted on said first tractor and displaceable to at least two settings, a locked position and an unlocked position, and a hold portion integrally formed with said lock lever for holding and securing said linear member relative to said first tractor when said lock lever is displaced to said locked position.

13. The successive sheet feed mechanism, as claimed in claim 12, wherein said lock lever is rotatably mounted on said first tractor for rotatable displacement between said unlocked and locked positions.

14. The successive sheet feed mechanism, as claimed in claim 12, wherein said first tractor is formed with a hold portion for cooperation with said hold portion of said fixing assembly to hold said first tractor relative to said linear member in said locked position.

15. The successive sheet feed mechanism, as claimed in claim 1, wherein said loosening assembly includes a loosening member, said loosening member being shaped to forcibly displace said linear member into a projecting shape at a position thereof intermediate said fixing assembly and said second frame against the tension force of said energizing member when said linear member and said first tractor are not fixed to each other by said fixing assembly, said loosening member being displaceable essentially simultaneously with or after said fixing assembly is operated to fix said linear member relative to said first tractor to free said projecting shape of said linear member to cause a loosened portion to form in said linear member.

16. The successive sheet feed mechanism, as claimed in claim 15, wherein said fixing assembly includes a lock lever mounted on said first tractor and displaceable to at least two settings, a locked position and an unlocked position, and a hold portion integrally formed with said lock lever for holding and securing said linear member relative to said first tractor when said lock lever is displaced to said locked position.

17. The successive sheet feed mechanism, as claimed in claim 16, wherein said loosening assembly includes a displaceable member operatively coupled to said lock lever for displacement therewith and for displacement into and out of engagement with said loosened portion of said linear member.

18. The successive sheet feed mechanism, as claimed in claim 17, wherein said loosening assembly includes an eccentric cam rotatably mounted for rotation with said lock lever.

19. The successive sheet feed mechanism, as claimed in claim 17, wherein said loosening assembly includes a hook member for engaging and displacing said linear member when said lock lever is in the unlocked position.

* * * * *